US007417017B2

(12) United States Patent
Bastigkeit et al.

(10) Patent No.: US 7,417,017 B2
(45) **Date of Patent: *Aug. 26, 2008**

(54) DETERGENT COMPOSITIONS WITH UNIQUE BUILDER SYSTEM FOR ENHANCED STAIN REMOVAL

(75) Inventors: Thorsten Bastigkeit, Scottsdale, AZ (US); Jessica Lawshe, Chandler, AZ (US); Joan Bergstrom, Phoenix, AZ (US); Daniel Wood, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 82 days.

This patent is subject to a terminal disclaimer.

(21) Appl. No.: 11/516,894

(22) Filed: Sep. 7, 2006

(65) Prior Publication Data

US 2008/0064619 A1 Mar. 13, 2008

(51) Int. Cl.

| | |
|---|---|
| ***C11D 1/02*** | (2006.01) |
| ***C11D 1/72*** | (2006.01) |
| ***C11D 1/83*** | (2006.01) |
| ***C11D 3/08*** | (2006.01) |
| ***C11D 3/37*** | (2006.01) |
| ***C11D 17/08*** | (2006.01) |

(52) U.S. Cl. ..... 510/340; 510/276; 510/351; 510/352; 510/356; 510/357; 510/360; 510/361; 510/421; 510/426; 510/434; 510/466; 510/477; 510/492; 510/505

(58) Field of Classification Search ..... 510/276, 510/340, 351, 352, 356, 357, 360, 361, 421, 510/426, 434, 466, 477, 492, 505
See application file for complete search history.

(56) References Cited

U.S. PATENT DOCUMENTS

| | | | |
|---|---|---|---|
| 2,954,347 | A | 9/1960 | St. John et al. |
| 2,954,348 | A | 9/1960 | Schwoeppe et al. |
| 3,707,503 | A | 12/1972 | Kenny et al. |
| 3,892,680 | A | 7/1975 | Benjamin et al. |
| 3,929,663 | A | 12/1975 | Arai et al. |
| 4,009,114 | A | 2/1977 | Yurko |
| 4,304,680 | A | 12/1981 | Wixon |
| 4,692,275 | A | 9/1987 | Secemski et al. |
| 5,425,891 | A | 6/1995 | Pujol et al. |
| 6,025,316 | A | 2/2000 | Cao et al. |
| 6,387,868 | B1 | 5/2002 | Uno et al. |
| 6,451,752 | B1 | 9/2002 | Delroisse et al. |
| 2006/0166853 | A1 | 7/2006 | Feyt |

FOREIGN PATENT DOCUMENTS

| | | | |
|---|---|---|---|
| EP | 971022 | * | 1/2000 |

* cited by examiner

*Primary Examiner*—Brian P Mruk
(74) *Attorney, Agent, or Firm*—Paul A. Pappalardo

(57) ABSTRACT

A unique liquid laundry detergent with enhanced stain removal capacity on bleachable stains is described that comprises linear alkyl benzene sulfonate, alkyl ether sulfate, alcohol ethoxylate, alkali metal silicate, polyacrylate, and optionally carbonate. The composition is remarkably effective at stain removal although the composition is entirely devoid of enzymes and the wash conditions devoid of any bleach additives.

9 Claims, No Drawings

DETERGENT COMPOSITIONS WITH UNIQUE BUILDER SYSTEM FOR ENHANCED STAIN REMOVAL

FIELD OF INVENTION

The present invention relates to detergent compositions that exhibit enhanced stain removal of bleachable stains in the absence of any added bleach or enzyme actives. In particular, this invention relates to a detergent composition utilizing a unique builder system comprising silicate for enhanced stain removal.

BACKGROUND OF THE INVENTION

Liquid laundry detergents have been known in the art for many decades.

Modern detergents are preferably comprised of blends of anionic and nonionic surfactants with any number of ingredients being added in order to improve cleaning performance and reduce the cost of these formulations. In recent times, laundry detergents have undergone significant reduction in levels of surfactants. These formulations with their corresponding low active levels are somewhat ineffective at stain removal. Often enzymes are included in these liquid compositions in order to improve performance. The addition of a chlorine or color-safe bleach added directly to the wash water in the laundry machine as a separate product is needed due to the deficiencies of these products.

For example, U.S. Pat. No. 6,025,316 (Cao et al.) discloses detergent compositions with good performance in the absence of bleach actives. However, although the compositions comprise common synthetic anionic and nonionic surfactants along with fatty acids and polymers, the claimed and preferred compositions comprise enzymes to facilitate the stain removal.

U.S. Pat. No. 6,387,868 (Uno et al.) discloses clear liquid laundry detergent compositions comprising linear alkyl benzene sulfonate, sodium silicate, alkyl ether sulfate, nonionic surfactant, (either alcohol ethoxylate or phenol ethoxylates), metal-chelating agent, pH adjuster, freezing/clouding inhibitor, water and optional components, preferably a fluorosurfactant. The complexity of the formulations is noteworthy, and there is mention in the disclosure of the difficulties in obtaining clear and stable liquid compositions comprising these types of synthetic surfactants and sodium silicate ('868, column 1, lines 46-54), which apparently precipitated the need for the added amide surfactants and other adjuncts to gain freeze/thaw stability.

U.S. Pat. No. 6,451,752 (Delroisse et al.) discloses a method of pre-treating bleachable stains with a composition comprising a transition metal complex that functions as a bleach catalyst, bringing atmospheric oxygen to the stain for bleaching.

US Patent Application Publication US 2006/0166853 (Feyt) describes an approach to increased stain removal in the absence of bleach actives. The inventors describe the use of a fructan derivative, most preferably a carboxyalkylinulin, a dicarboxyinulin, 6-carboxylinulin, or fructan polycarboxylic acid in detergent compositions.

Finally, U.S. Pat. NO. 4,692,275 (Secemski et al.) discloses powdered compositions with linear alkyl benzene sulfonate (LAS), alcohol ether sulfate (AES), silicate, carbonate, polyacrylate and other adjuncts. The inventors teach preferred ratios of sulfonate to sulfate of from about 3.5:1 to about 1.5:1, that is they teach incorporating more sulfonate than sulfate in their compositions. In the highly built laundry powders described in the '275 patent, it is preferable to have LAS>AES such that mixed micelles mitigate the precipitation of the hard water salts of the benzene sulfonate surfactant.

A perusal of the prior art demonstrates a clear need for improved liquid laundry detergent compositions that show enhanced efficacy on bleachable stains yet do not contain any bleach actives or enzymes of any kind. Particularly there is an absence of practical, inexpensive liquid laundry detergent compositions that demonstrate high efficacy and that can bleach stains only through the use of selected combinations of common surfactant and builders.

It has now been surprisingly found that the combination of silicate with polyacrylate and specific anionic and nonionic surfactants produces detergent compositions that exhibit exceptional stain removal capability. Unexpectedly, silicate has been found to be the key to the enhanced bleaching of bleachable stains in the absence of traditional bleach and enzyme actives.

SUMMARY OF THE INVENTION

Our summary of the invention is intended to introduce the reader to general aspects of the detergent compositions and not intended to be a complete description. Particular aspects of the present invention are described in other sections below.

In accordance with an exemplary embodiment of the present invention, a liquid laundry detergent composition is provided that shows remarkable stain removal capability even though the composition is devoid of any known bleach actives and any enzymatic activity. The liquid laundry detergent compositions of the present invention comprise both anionic sulfonate and sulfate surfactant components in preferred ratios, nonionic surfactant, polyacrylate polymer, and most importantly silicate. In accordance with another exemplary embodiment of the present invention, a liquid laundry detergent composition is provided with these components above, along with carbonate as additional builder. Performance data clearly demonstrates that the addition of silicate markedly improves the stain removal of bleachable stains.

DETAILED DESCRIPTION OF THE INVENTION

The following description is of exemplary embodiments only and is not intended to limit the scope, applicability or configuration of the invention in any way.

Rather, the following description provides a convenient illustration for implementing exemplary embodiments of the invention. Various changes to the described embodiments may be made in the function and relative amounts of components described without departing from the scope of the invention as set forth in the appended claims.

The present invention relates to a composition for laundering fabrics that exhibits enhanced stain removal on bleachable stains. The liquid laundry detergent compositions of the present invention include anionic surfactant components, preferably sulfonate and sulfate compounds that together total from about 1.5%-14%, nonionic surfactant preferably from about 0.5-5%, polyacrylate homopolymer from about 0.1-1%, and silicate from about 0.5-5%. In accordance with another exemplary embodiment, a liquid laundry detergent composition is provided with these components along with carbonate builder present at up to about 4%.

Anionic surfactants that are useful in the compositions of the present invention are the alkyl benzene sulfonates. Suitable alkyl benzene sulfonates include the sodium, potassium, ammonium, lower alkyl ammonium and lower alkanol ammonium salts of straight or branched-chain alkyl benzene sulfonic acids. Alkyl benzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids, functioning as precursors to the alkyl benzene sulfonates useful for compositions herein, are those in which the alkyl chain is linear and averages about 8 to 16 carbon atoms ($C_8$-$C_{16}$) in length. Examples of commercially available alkyl benzene sulfonic acids useful in the present invention include Calsoft® LAS-99, Calsoft® LPS-99 or Calsoft®TSA-99 marketed by the Pilot Chemical Company. Most preferred for use in the present invention is sodium dodecylbenzene sulfonate, most easily available by the in-situ neutralization of the above mentioned sulfonic acids with caustic (NaOH) or other alkalinity present in the composition, or available commercially as the sodium salt of the sulfonic acid, for example Calsoft® F-90, Calsoft® P-85, Calsoft® L-60, Calsoft® L-50, or Calsoft® L-40. Also of use in the present invention are the ammonium salts, lower alkyl ammonium salts and the lower alkanol ammonium salts of linear alkyl benzene sulfonic acid, such as triethanol ammonium linear alkyl benzene sulfonate including Calsoft® T-60 marketed by the Pilot Chemical Company. The preferred level of sulfonate surfactant in the present invention is from about 0.5% to about 4%. Most preferred is to use dodecylbenzene sulfonic acid (LAS) at a level of from about 1% to about 3% (which will react in-situ to sodium dodecyl benzene sulfonate in the final compositions of the present invention).

Also with respect to the anionic surfactants useful in this composition, the alkyl ether sulfates, also known as alcohol ether sulfates, are preferred. Alcohol ether sulfates are the sulfuric monoesters of the straight chain or branched alcohol ethoxylates and have the general formula $R—(CH_2CH_2O)_x—SO_3M$, where $R—(CH_2CH_2O)_x—$ preferably comprises $C_7$-$C_{21}$ alcohol ethoxylated with from about 0.5 to about 9 mol of ethylene oxide (x=0.5 to 9 EO), such as $C_{12}$-$C_{18}$ alcohols containing from 0.5 to 9 EO, and where M is alkali metal or ammonium, alkyl ammonium or alkanol ammonium counterion. Preferred alkyl ether sulfates for use in one embodiment of the present invention are $C_8$-$C_{18}$ alcohol ether sulfates with a degree of ethoxylation of from about 0.5 to about 9 ethylene oxide moieties and most preferred are the $C_{12}$-$C_{15}$ alcohol ether sulfates with ethoxylation from about 4 to about 9 ethylene oxide moieties, with 7 ethylene oxide moieties being most preferred. It is understood that when referring to alkyl ether sulfates, these substances are already salts (hence "sulfonate"), and most preferred and most readily available are the sodium alkyl ether sulfates (also referred to as NaAES). Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, however most of these have fairly low EO content (e.g., average 3 or 4-EO). Alternatively the alkyl ether sulfates for use in the present invention may be prepared by sulfonation of alcohol ethoxylates (i.e., nonionic surfactants) if the commercial alkyl ether sulfate with the desired chain lengths and EO content are not easily found, but perhaps where the nonionic alcohol ethoxylate starting material may be. For example, sodium lauryl ether sulfate ("sodium laureth sulfate", having about 3 ethylene oxide moieties) is very readily available commercially and quite common in shampoos and detergents, however, this is not the preferred level of ethoxylation for use in the present invention. Therefore it may be more practical to sulfonate a commercially available nonionic surfactant such as Neodol® 25-7 Primary Alcohol Ethoxylate (a $C_{12}$-$C_{15}$/7EO nonionic from Shell) to obtain the $C_{12}$-$C_{15}$/7EO alkyl ether sulfate that may have been more difficult to source commercially. The preferred level of $C_{12}$-$C_{18}$/0.5-9EO alkyl ether sulfate in the present invention is from about 1% to about 10%. Most preferred is from about 3% to about 8%.

Most preferred for use in the compositions of the present invention is a mixture of both types of anionic surfactants described above. That is, it is preferable to incorporate both the linear alkyl benzene sulfonate and alcohol ether sulfate surfactants in the same compositions. Most preferable is to incorporate sodium dodecyl benzene sulfonate and $C_{12}$-$C_{15}$/7EO sodium alkyl ether sulfate together in the compositions of the present invention, and to incorporate a total linear alkyl benzene sulfonate and alkyl ether sulfate level of from about 1.5% to about 14%, and most preferably from about 2% to about 12%. A ratio of sulfonate to sulfate of from about 1:1.5 to about 1:20 is preferred, and a ratio of from about 1:2 to about 1:4 is most preferred. This is in sharp contrast to the prior art (e.g., U.S. Pat. No. 4,692,275, mentioned above) that teaches using ratios of sulfonate to sulfate where there is a greater amount of sulfonate than sulfate. We have found that a greater amount of sulfate to sulfonate to be the most effective blend when used synergistically with the silicate builder for stain removal.

The compositions of the present may include a nonionic surfactant. Nonionic surfactants are particularly good at removing oily soils from fabrics. Nonionic surfactants useful in the present invention include ethoxylated and/or propoxylated, primary alcohols having 10 to 18 carbon atoms and on average from 4 to 10 mol of ethylene oxide (EO) and/or from 1 to 10 mol of propylene oxide (PO) per mole of alcohol. Further examples are alcohol ethoxylates containing linear radicals from alcohols of natural origin having 12 to 18 carbon atoms, e.g., from coconut, palm, tallow fatty or oleyl alcohol and on average from 4 to 9 EO per mole of alcohol. In formulating the liquid detergent composition of the present invention, nonionic surfactants of the alcohol ethoxylate type are useful since a proper HLB balance can be achieved between the hydrophobic and hydrophilic portions of the surfactant. Most useful in the present invention is the $C_{14}$-$C_{15}$ alcohol ethoxylate-7EO, mentioned above as a useful precursor to the corresponding sulfate and available commercially under the Neodol® brand from Shell. This particular nonionic, or other alcohol ethoxylate surfactants falling within the general formula $C_{12}$-$C_{18}$ alcohol ethoxylate/4-9EO, is best incorporated at a level of from about 0.5% to about 5%.

The compositions of the present invention contain one or more silicate substances to enhance the bleaching of bleachable stains. The preferred silicate is an alkali metal silicate salt (the alkali metal salts of silicic acid) with the sodium and potassium silicate salts being the most preferred. The alkali metal silicates that are useful may be in a variety of forms that can be described by the general formula $M_2O:SiO_2$, wherein M represents the alkali metal and in which the ratio of the two oxides varies. Most useful alkali metal silicates will have a $SiO_2/M_2O$ weight ratio of from about 1.6 to about 4. These silicates also provide excess alkalinity to the composition (and to the resulting laundry wash liquor), making for highly alkaline compositions and wash solutions. Preferred silicates include the Sodium Silicate Solutions from PQ Corporation, such as A®1647 Sodium Silicate Solution, a 46.8% active solution of sodium silicate having a $SiO_2/Na_2O$ ratio of about 1.6. Also of use in the compositions of the present invention are the potassium silicates, such as the Kasil® products from PQ Corporation. For example, Kasil®1 Potassium Silicate Solution is of use in the present invention and is a 29.1% solution of potassium silicate having a $SiO_2/K_2O$ ratio of about 2.5. It is preferable to use either sodium or potassium silicate at a level of from about 0.5% to about 5% in the compositions of the present invention.

The compositions of the present invention include a water-soluble polymer such as a polycarboxylate. Particularly suitable polymeric polycarboxylates are derived from acrylic acid, and this polymer and the corresponding neutralized forms include and are commonly referred to as polyacrylic acid, 2-propenoic acid homopolymer or acrylic acid polymer, and sodium polyacrylate, 2-propenoic acid homopolymer sodium salt, acrylic acid polymer sodium salt, poly sodium acrylate, or polyacrylic acid sodium salt. Preferred in the compositions of the present invention is sodium polyacrylate with average molecular weight from about 2,000 to 10,000, more preferably from about 4,000 to 7,000 and most preferably from about 4,000 to 5,000. Soluble polymers of this type are known materials, for example the sodium polyacrylates and polyacrylic acids from Rohm and Haas marketed under the trade name Acusol®. Of particular use in the present invention is the average 4500 molecular weight sodium polyacrylate and the preferred level for use in the composition is from about 0.1% to about 1%.

The compositions of the present invention may contain alkali metal carbonate builder at a level of from about 0.1% to about 4%. Useful in the present invention is sodium carbonate, however potassium carbonate may be used as well. It is well known that sodium carbonate is available in several forms including an anhydrous form as well as three hydrated forms. The hydrated forms include monohydrate, heptahdrate and decahydrates. Any of the commercially available forms of sodium or potassium carbonate find use in the present invention, recognizing that the carbonate need not be anhydrous since it is being incorporated into an aqueous system anyway.

Optional ingredients in the compositions of the present invention include fatty acid soaps. The fatty acids that may find use as optional ingredients in the present invention may be represented by the general formula R—COOH, wherein R represents a linear or branched alkyl or alkenyl group having between about 8 and 24 carbons. It is understood that within the compositions of the present invention, the free fatty acid form (the carboxylic acid) will be converted to the alkali metal salt in-situ (that is, to the fatty acid soap, or the more formally the "carboxylate salt"), by the excess alkalinity present in the composition. As used herein, "soap" means salts of fatty acids. Thus, after mixing and obtaining the compositions of the present invention, the fatty acids will be present in the composition as R—COOM, wherein R represents a linear or branched alkyl or alkenyl group having between about 8 and 24 carbons and M represents an alkali metal such as sodium or potassium. The fatty acid soap, which is a desirable component having suds reducing effect in the washer, (and especially advantageous for side loading or horizontal tub laundry machines), is preferably comprised of higher fatty acid soaps. The fatty acids that are added directly into the compositions of the present invention may be derived from natural fats and oils, such as those from animal fats and greases and/or from vegetable and seed oils, for example, tallow, hydrogenated tallow, whale oil, fish oil, grease, lard, coconut oil, palm oil, palm kernel oil, olive oil, peanut oil, corn oil, sesame oil, rice bran oil, cottonseed oil, babassu oil, soybean oil, castor oil, and mixtures thereof. Fatty acids can be synthetically prepared, for example, by the oxidation of petroleum, or by hydrogenation of carbon monoxide by the Fischer-Tropsch process. The fatty acids of particular use in the present invention are linear or branched and containing from about 8 to about 24 carbon atoms, preferably from about 10 to about 20 carbon atoms and most preferably from about 14 to about 18 carbon atoms. Preferred fatty acids for use in the present invention are tallow or hydrogenated tallow fatty acids. Preferred salts of the fatty acids are alkali metal salts, such as sodium and potassium or mixtures thereof and, as mentioned above, preferably the soaps generated in-situ by neutralization of the fatty acids with excess alkali from the silicate. Other useful soaps are ammonium and alkanol ammonium salts of fatty acids, with the understanding that these soaps would necessarily be added to the compositions as the preformed ammonium or alkanol ammonium salts and not neutralized in-situ within the compositions of the present invention, (in the instant invention, in-situ neutralization of the fatty acids will necessarily generate sodium or potassium salts, or mixtures thereof of the fatty acids, due to the presence of the silicate having excess alkali). The fatty acids that may be included in the present compositions will preferably be chosen to have desirable detergency and effective suds reducing effect. Of course, for compositions wherein foaming is desirable soap content is omitted or lowered or a lower fatty acid soap, e.g., sodium laurate, may be used instead, but this is not the preferred strategy for the compositions of the present invention where suds suppression is desired.

Lastly, other optional ingredients may include other anionic surfactants in addition to alkyl benzene sulfonate and the alkyl ether sulfates mentioned above, particularly for example alkyl sulfates. Additionally, other nonionic surfactants such as the amphoteric surfactants and alkylpolyglycoside surfactants may find use in the compositions of the present invention. Optional too are other builder components besides the silicates and carbonates mentioned previously, lending an additional source of alkalinity or hard water chelation such as borates, tetrasodium ethylenediamine tetraacetate-EDTA, phosphates, zeolite, NTA and the like, bleaching agents (oxygen or chlorine based) to further enhance bleaching, optical brighteners, dye fixatives, enzymes, binders, carrier materials and auxiliary ingredients, and minor amounts of perfumes, dyes, solvents, etc. (e.g. cationic surfactants, softening or antistatic agent, water, thickeners, emulsifiers, acids, bases, salt, polymer, bleach catalysts, peroxygen compounds, inorganic or organic absorbents, clays, surface modifier polymer, pH-control agents, other chelants, active salts, abrasives, preservatives, colorants, anti-redeposition agents, opacifiers, anti-foaming agents, cyclodextrines, rheology-control agents, vitamins, oils, nano-particles, visible plastic particles, visible beads, etc.).

With the necessary and optional ingredients thus described, exemplary embodiments of the liquid laundry detergent compositions of the present invention, with each of the components set forth in weight percent, are shown as Formulations 1 and 3, along with a non-silicated reference composition outside the scope of the present invention, shown as Formulation 2, as follows:

| | Weight Percent (actives %) | | |
|---|---|---|---|
| | Formulation 1 | Formulation 2 | Formulation 3 |
| Ingredients (as present after blending) | | | |
| Sodium dodecyl benzene sulfonate | 1.25 | 1.25 | 2.00 |
| Sodium alkyl $C_{14}$-$C_{15}$/7EO ether sulfate | 3.00 | 3.00 | 8.00 |
| $C_{14}$-$C_{18}$ Fatty Acid soaps (sodium salts) | 0.15 | 0.15 | 0.45 |
| Linear alcohol ethoxylate $C_{14}$-$C_{15}$/7EO | 1.80 | 2.20 | 3.00 |
| Sodium Silicate $SiO_2/Na_2O$ ratio = 1.6 | 2.00 | 0 | 3.00 |
| Sodium Carbonate | 2.70 | 3.50 | 0.50 |
| Sodium polyacrylate 4,500 MW | 0.20 | 0.20 | 0.25 |
| Dyes and fragrances | 0.30 | 0.30 | 0.60 |
| Water | q.s | q.s. | q.s |
| Formula Characteristics | | | |
| PH (final) | 12.0 | 10.5 | 12.3 |
| Ratio of sulfonate:sulfate | 1:2.4 | 1:2.4 | 1:4 |

To demonstrate the bleaching performance characteristics of various formulations of the liquid detergent compositions of the present invention, tests were conducted to determine the stain removal capability of the various formulations. For evaluation purposes, under U.S. wash conditions, Kenmore Elite washers were used. The following conditions were used: Medium load, warm wash (100° F.), cold rinse, heavy duty agitation, 14 minute wash cycle, 1 rinse cycle, and addition of 150 ppm hard water to 150 ppm. The assessment of the removal of individual stain is determined by the color change of the stains as determined using a calorimeter. Similarly sized 100% cotton knit pieces of fabric that were each stained with one of chocolate ice cream, chocolate milk, grape juice, tea and wine were washed in a washing liquor containing water and one of the three formulations shown above. The stain removal capabilities of these three formulations were compared after washing the test pieces against white 100% cotton knit pieces of fabric. Stain removal was assessed using color readings from a Gardner Color-Guide Spectrophotometer Model 45/0. As evidenced above, Formulations 1 and 3 are both significantly better at stain removal than Formulation 2 that doesn't contain the silicate, (noting a lower number in the table is more stain removal and a better result):

| Average | Remaining Stain (%) | | |
|---|---|---|---|
| and Specific Stains | Formulation 1 | Formulation 2 | Formulation 3 |
| Average Stain Groups | | | |
| Fats and Pigments | 9.69 | 13.51 | 7.40 |
| Bleachable Stains | 2.34 | 4.69 | 1.30 |
| Enzyme Sensitive Stains | 1.48 | 2.07 | 1.41 |
| Specific Stains | | | |
| Chocolate Ice Cream | 15.03 | 21.03 | 9.80 |
| Chocolate Milk | 2.92 | 7.73 | 1.48 |
| Grape Juice | 5.04 | 9.47 | 5.38 |
| Tea | 17.59 | 21.36 | 14.68 |
| Wine | 3.62 | 6.34 | 2.00 |

As described and embodied above, we have disclosed a unique liquid laundry detergent composition comprising surfactants and silicate that show remarkable bleaching performance on bleachable stains in the complete absence of bleach or enzyme actives. The compositions require a unique ratio of sulfonate to sulfate, ranging between 1:1.5 to 1:20 with sulfate being the greater of the two, in synergistic combination with silicate to effect stain removal of bleachable stains in the absence of standard peroxygen or chlorine bleach or enzymes. Silicate appears to have a synergistic effect with the surfactant combination to effect enhanced stain removal of bleachable stains.

We claim:

1. A liquid laundry detergent composition comprising:

a. from about 0.5% to about 4% by weight of linear alkyl benzene sulfonate surfactant;

b. from about 1% to about 10% by weight of an alkyl ether sulfate surfactant;

c. from about 0.5% to about 5% by weight of an alcohol ethoxylate nonionic surfactant;

d. from about 0.5% to about 5% of an alkali metal silicate;

e. from about 0.1% to about 1% of sodium polyacrylate homopolymer having molecular weight from about 2,000 to about 10,000; and f. the balance water, wherein the weight ratio of said linear alkyl benzene sulfonate surfactant to alkyl ether sulfate surfactant is from about 1:1.5 to about 1:20.

2. The composition of claim 1 wherein the said linear alkyl benzene sulfonate surfactant is sodium dodecylbenzene sulfonate.

3. The composition of claim 1 wherein the said alkyl ether sulfate further comprises sodium alkyl ether sulfate with alkyl group carbon chain length of from about 12 to about 18 and a degree of ethoxylation of from about 1.5 to about 9 ethylene oxide moieties.

4. The composition of claim 1 wherein the said alcohol ethoxylate nonionic surfactant has carbon chain length of from about 12 to about 18 and a degree of ethoxylation of from about 4 to about 9 ethylene oxide moieties.

5. The composition of claim 1 wherein said silicate is sodium silicate having a $SiO_2/Na_2O$ weight ratio of from about 1.6 to about 4.

6. The composition of claim 1 wherein said silicate is potassium silicate having a $SiO_2/K_2O$ weight ratio of from about 1.6 to about 4.

7. The composition of claim 1 wherein said sodium polyacrylate homopolymer has an average molecular weight of from about 4,000 to about 5,000.

8. The composition of claim 1 wherein said composition further comprises a fatty acid soap selected from the group consisting of sodium salts of saturated $C_{14}$-$C_{18}$ carboxylic acids, sodium salts of unsaturated $C_{14}$-$C_{18}$ carboxylic acids, potassium salts of saturated $C_{14}$-$C_{18}$ carboxylic acids, potassium salts of unsaturated $C_{14}$-$C_{18}$ carboxylic acids, and mixtures thereof.

9. The composition of claim 1 wherein said composition further comprises from about 0.1% to about 4% by weight of an alkali metal carbonate selected from the group consisting of anhydrous potassium carbonate, hydrated potassium carbonate, anhydrous sodium carbonate, hydrated sodium carbonate and mixtures thereof.

* * * * *